US008070543B1

(12) United States Patent
Faletra

(10) Patent No.: US 8,070,543 B1
(45) Date of Patent: Dec. 6, 2011

(54) INFLATABLE LIFE RAFT WITH DETACHABLE ACCESSORY POUCH

(76) Inventor: Troy Faletra, Fort Lauderdale, FL (US)

( * ) Notice: Subject to any disclaimer, the term of this patent is extended or adjusted under 35 U.S.C. 154(b) by 204 days.

(21) Appl. No.: 12/427,292

(22) Filed: Apr. 21, 2009

Related U.S. Application Data

(60) Provisional application No. 61/060,151, filed on Jun. 10, 2008.

(51) Int. Cl.
*B63C 9/08* (2006.01)

(52) U.S. Cl. ..... 441/40

(58) Field of Classification Search ..... 441/40–42, 441/88, 90–92, 96
See application file for complete search history.

(56) References Cited

U.S. PATENT DOCUMENTS

| | | | | |
|---|---|---|---|---|
| 2,114,301 | A * | 4/1938 | Harrigan | 244/148 |
| 6,394,867 | B1 * | 5/2002 | Bianco | 441/126 |
| 6,582,097 | B2 * | 6/2003 | Chang | 362/253 |
| 7,083,487 | B2 * | 8/2006 | Weinel | 441/88 |

* cited by examiner

*Primary Examiner* — Daniel Venne
(74) *Attorney, Agent, or Firm* — Gold & Rizvi, P.A.; H. John Rizvi; Glenn E. Gold

(57) ABSTRACT

An inflatable life raft having one or more air channels forming a generally rectangular shaped body when the raft is unfolded and inflated. Valves in fluid communication with the air channels for inflating and deflating the life raft. The inflatable raft includes a waterproof pouch releasably attached to the raft for storing items such as a rope, flare launcher, strobe light, glow sticks, and whistle. An ankle tether couples the life raft to a user, and a plurality of reflectors are attached to the surface of the inflatable life raft. For added convenience, a storage means is integrally constructed with the life raft for storing the folded normally deflated life raft so that the raft can be easily carried and transported. A replaceable gas cylinder, and manual hand pump are operatively coupled to the valves for automatically or manually inflating the life raft.

20 Claims, 14 Drawing Sheets

INFLATABLE LIFE RAFT WITH DETACHABLE ACCESSORY POUCH

CROSS REFERENCE TO RELATED APPLICATION

This Non-Provisional patent application claims the benefit of U.S. Provisional Patent Application Ser. No. 61/060,151, filed on Jun. 10, 2008, which is incorporated herein in its entirety.

FIELD OF INVENTION

The present invention relates to floatation devices, and more particularly, to an inflatable life raft adaptable for recreational use or personal safety. The inflatable life raft includes a detachable waterproof pouch, a tether, reflectors and a storage means for storing the raft in a deflated, folded form for easily carrying and transporting the life raft.

BACKGROUND OF THE INVENTION

There are a variety of floatation devices available on the market today. Some examples of floatation devices include boats, rafts, mattresses, tubes, watercrafts and floats. Some of the floatation devices are formed from pressurized pontoons, shaped fiberglass, or a dense foam material designed to provide the requisite bouncy needed for the floatation device to remain afloat. Popular floatation devices known in the art include inflatable devices. Inflatable devices provide the advantages of being compact, inexpensive to purchase, lightweight, and easy to store and transport when deflated.

Generally, inflatable devices are designed for either recreational use or are adapted for emergency or rescue operations. Most inflatable devices used for recreational activities typically include inflatable rafts or mattresses that are fabricated from a plastic material forming one or more inflatable chambers for receiving air therein through an inflation valve. Most inflatable rafts do not provide an integrally formed storage means for storing the raft when deflated. It is common that on many occasions, a user does not take the requisite time needed to adequately deflate the inflatable raft after use, resulting in the raft material rotting over time. In those occasions when a user does deflate the inflatable life raft, the user generally gathers the deflated raft together in a bundle making it difficult for storing, carrying and transporting the bulky raft. Most prior art inflatable rafts cannot be easily stored in a backpack, in luggage, hung in the closet, or conveniently transported effectively.

On occasion, a user may wish to bring along accessories when using an inflatable raft. Some examples of accessories may include beverages, food, rope, or safety equipment in general. Prior art inflatable rafts do not provide a means for storing accessories on the raft itself. In most situations, the user must store accessories in a separate container typically worn on the person or left in a nearby location away from the raft. Carrying and transporting a separate container on the person or leaving the container nearby for use is cumbersome, and often times impractical. In addition, most prior art inflatable rafts typically include a cord or rope attached to the raft for allowing a user to grasp the rope with one hand to hold onto the raft. However, the user is forced to actively hold onto the rope with the one hand making it difficult for the user to make use of both hands that may be freely used for swimming or signaling.

Often times when boating, some individuals feel nervous in relying only on a lift jacket. For some people a life jacket is just not enough. In the event of an emergency on the water, the life jacket does not offer the luxury of having life saving accessories available to the wearer. Further, in situations where only one floatation device is available to a plurality of people, such as a lifeboat, many individuals have difficulty swimming or simply cannot swim to a deployed lifeboat. Lifeboats tend to be bulky, expensive and permanently stored on a vessel.

Accordingly, there remains in the art a need for an inflatable life raft designed for recreational use, emergency use, or rescue operations where the inflatable life raft is inexpensive, easy to inflate, and includes a detachable accessory pouch for storing a variety of accessories available to a user. There is also a need for an inflatable life raft that is stored in a compact carrying case in folded form for easy transport, is readily accessible to anyone in time of need, and can be easily stored in a variety of places.

SUMMARY OF THE INVENTION

The present invention overcomes the deficiencies of the known art and the problems that remain unsolved by providing an inflatable recreational or personal safety life raft having a removable waterproof pouch for storing safety contents therein. The inflatable life raft includes an ankle tether for coupling the life raft to a user, and a plurality of reflectors for signaling the location and position of the life raft.

In accordance with one embodiment of the present invention, there is provided a folded normally deflated life raft comprising a plurality of longitudinal extending air channels in parallel series with each other forming a generally rectangular shaped body when the life raft is unfolded and inflated. Valves are in fluid communication with the air channels for inflating and deflating the air channels. An accessory pouch is releasably attached to one surface of the body, wherein the accessory pouch is shaped and sized to store a plurality of accessories therein. A tether is connected to the body and is adapted for being removeably connected to a user's waist, ankle or wrist. For added convenience, a storage means is integrally constructed with the body, where the storage means includes a fastener for securely storing the folded normally deflated life raft therein. The storage means also includes a clip for securing the folded life raft to a person, object or for hanging.

Preferably, the folded normally deflated life raft is fabricated from a resilient material comprising any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

Advantageously, the valves comprise a one way inflation valve for inflating the life raft, the one way inflation valve including a pivoting stem and mouth piece, and a deflator valve for releasing air from the air channels. The tether includes a tether strap having one end attached to the body, and a second end attached to an ankle attachment for removeably coupling the life raft on a user's ankle, wrist, belt or waist.

Preferably, the accessory pouch includes a fastener for securely storing a plurality of accessories. The plurality of accessories comprise a rope, a flare launching system, a strobe light, glow sticks, and a whistle. The whistle includes a receptacle for receiving items and keeping said items dry, and a closure having a reflecting mirror and a compass.

Advantageously, the normally folded deflated raft includes a plurality of reflectors disposed on the top surface of the body. The normally folded deflated life raft also includes a plurality of grommets disposed along an outside perimeter flap of the raft. One or more surfaces of the raft include any one of a plurality of different colors, a plurality of florescent colors, or any combination thereof.

In yet another embodiment, there is provided an inflatable device comprising a first resilient sheet joined and sealed to a second resilient sheet to form a generally, rectangular shaped body having an inflatable air chamber, and an outside perimeter flap. An envelope is integrally formed to the second resilient sheet where the envelope defines an opening for receiving the inflatable device in folded form. The envelope includes a fastener for securely storing the inflatable device therein, and a clip for attaching the inflatable device to a person, object or for hanging the device in a closet. Valves are in fluid communication with the air chamber for inflating and deflating the air chamber. A storage bag sized and shaped to store items therein is removeably attached to the first resilient sheet with a fastener, and a holding strap is attached to the inflatable device for coupling the inflatable device to a user's ankle, waste or wrist.

Preferably, the fastener includes any one of a spring clip, zipper, hook and loop, buckle, snaps, strap, cord, quick release, magnets, hooks, clasps, carabiner, or any combination thereof.

In an alternative embodiment there is provided an inflatable recreational or personal safety raft comprising a first resilient sheet joined and sealed to a second resilient sheet to form a rectangular shaped body having a plurality of longitudinally extending inflatable air tubes is parallel series with each other, and an outer perimeter flap. A storage means is integrally formed to the second resilient sheet. The storage means defines an opening for receiving the inflatable raft in folded deflated form. Valve means are in fluid communication with the inflatable air tubes. Included is a waterproof pouch adapted to store contents therein where the waterproof pouch is removeably attached to the first resilient sheet with a fastener. A tether is attached to the inflatable raft. The tether includes a fastener for coupling the inflatable raft to a user's ankle, waste or wrist.

Advantageously, the resilient sheets may comprise a single ply or multiple ply of any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

Advantageously, the inflatable device further includes a replaceable air cylinder, and a manual air pump. The replaceable air cylinder is stored within a cylinder loader and coupled to a one valve for inflating the life raft. A manual air pump is releasably coupled to another valve for manually inflating the life raft.

Regarding the embodiments described herein, as well as those covered by the claims, the inflatable device or life raft may be constructed in different sizes and dimensions, and include one or more fluorescent colors. The storage means or envelope may include markings, letters, indicia, figures, characters, numbers, or the like disposed on the outer surface for identification. The waterproof pouch, accessory pouch or storage bag is shaped and sized to hold a variety of different small items or products, and may include a transparent or opaque covering.

DETAILED DESCRIPTION

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention.

It will be understood that the terms "top", "bottom", "side", "left", "right", "front", "rear", "upper", "lower", "length", "width", "height", "depth", "horizontal" and "vertical" are utilized herein merely to indicate points of reference and do not limit the present invention to any specific orientation or configuration. In addition, the terms "accessories" or "items" as used herein includes all manner of small and portable items, products or articles, that a user may wish to keep secure and readily available, and the term "pouch" as used herein includes any container, receptacle, storage, bag, or any other means or method of storing items, articles or products.

Figure 1:
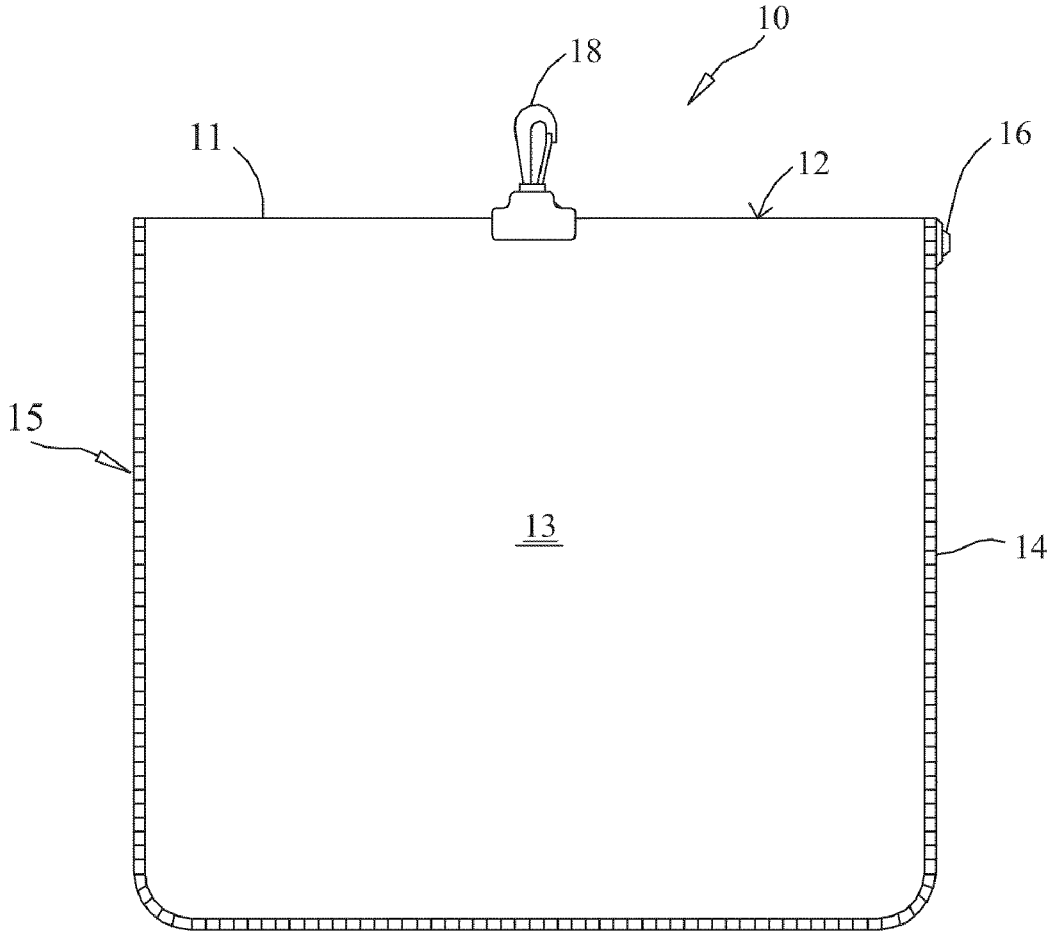
FIG. 1. is a plan view of an inflatable device deflated and folded in a storage means integrally constructed with the device, according to the present invention.

Referring now to the drawings wherein like elements are represented by like numerals throughout, there is shown in FIG. 1, a plan view of an inflatable device 10, preferably a life raft, shown normally, deflated and folded, according to the present invention. Life raft 10 is folded in both the longitudinal and transverse directions and conveniently stored in a storage means 12 integrally formed with or integrally attached to the bottom surface of raft 10, as better illustrated in FIG. 8. Storage means 12 includes a first storage panel 13 and a second storage panel 15, and is generally shaped and dimensioned to form a square or rectangular opening for receiving the inflatable lift raft 10 in folded form. A fastener 14, 16, preferably a zipper, is disposed partially along the outer perimeter of each storage panel 13, 15 to releasably join each panel 13, 15 together. Storage means 12 also includes a flexible, material hinge 11. Upon disengaging fastener 14, 16, storage panels 13, 15 are folded open along hinge 11 like a book to expose the contents of storage means 12. Examples of suitable fasteners 14, 16 may also include snaps, hook and loop fasteners, magnets or the like. Storage means 12 allows life raft 10 to be folded-up and arranged into the form of a hand bag or carrying bag.

A fastening means 18 is attached to the outer surface of the storage means 12 for releasably attaching the portable, inflatable life raft 10 to a person, life vest, belt, or for simply hanging the life raft 10, if desired. Fastening means 18 may include any one of a clamps, buckles, spring clips, clips, quick release buckles, snaps, rings, snap rings, eye-hooks, carabiners, hook and loop fasteners, displaced eyelets and lace, web slides, couplings, clasps, S-hooks, spring detents, fasteners, suction-cups, links, clasps, straps, any combination thereof, or any other suitable fastener known in the art.

The outer surface of either or both panels 13, 15, of inflatable life raft 10, may include any one of a variety of different colors, letters, characters, figures, symbols, markings, indicia, or the like. In one exemplary embodiment, the words, "Personal Safety Life Raft', may be printed on the outer surface of panel 13 to identify the device to a user. Further, storage means 12 may include one or more handles for easily carrying and transporting the lift raft 10.

Inflatable life raft 10 is constructed of a resilient, flexible material, and preferably shaped into a generally rectangular or square shape. The resilient material is composed of any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof. The material selected should be flexible or elastic enough to permit inflation of the life raft 10, yet, strong and durable enough to resist puncturing.

Preferably, single ply or multiply sheets, of the resilient, flexible material, are joined and sealed together along the outer edge or perimeter. In addition, the plural sheets of flexible material are sealed together along a plurality of longitudinal seams to form a series of inflatable air tubes, or channels. The inflatable tubes are arranged in parallel series with each other and are in fluid communication with each other. It will be understood that the single ply or multiply sheets may be sealed together using simple heat sealing methods, such as dielectric heating, sonic welding, gluing, using vulcanization techniques or any other well know methods of joining and sealing rubberized or thermoplastic materials together.

The inflatable life raft 10 may include a variety of different sizes. In some non-limiting examples, inflatable life raft 10 may be 49 inches in length and 29 inches in width, 60 inches in length and 29 inches in width, 72 inches in length and 29 inches in width, or 60 inches in length and 36 inches in width. These are but a few dimensional examples, and it will be understood that the inflatable life raft 10 of the present invention may be fabricated to provide a large variety of sizes to accommodate children and adults alike.

Figure 2:
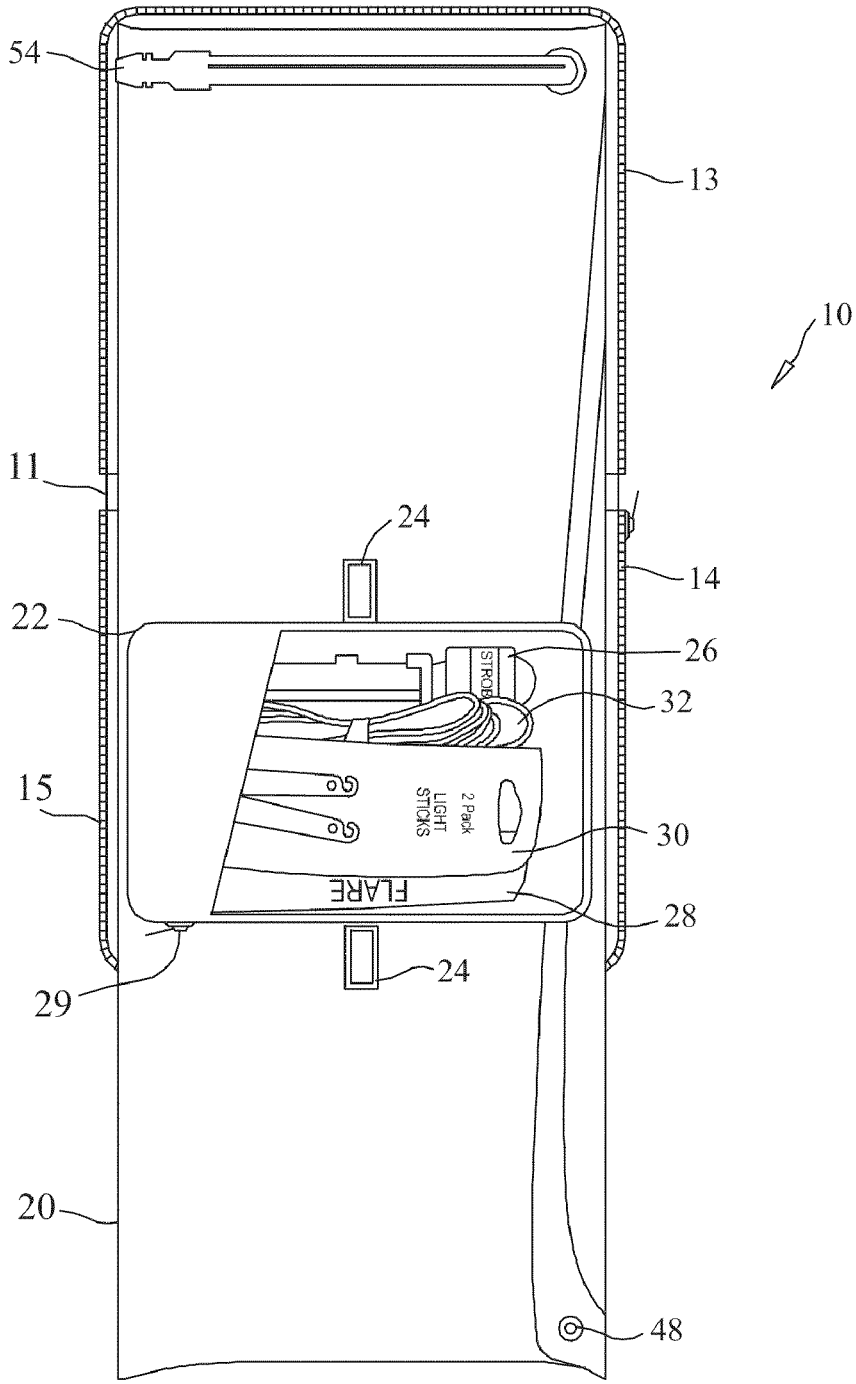
FIG. 2. is a top view of the inflatable device of FIG. 1, shown partially unfolded in a deflated state including a detachable accessory pouch, and an inflating valve, according to the present invention.

With reference now to FIG. 2, there is shown a top view of the inflatable life raft 10 of FIG. 1, shown partially unfolded in a deflated state, according to the present invention. Fastener 14, 16, of storage means 12 is unzipped and the panels 13, 15 are separated and opened like a book along hinge 11 to expose the inflatable life raft 10. As shown, inflatable life raft 10 includes an accessory pouch 22 detachably connected to one side of the raft 10 by pouch fasteners 24 such as hook and loop fasteners. Hook and loop fasteners 24 are affixed to the top surface of the life raft 10, and to the bottom surface of the accessory pouch 22. The pouch 22 is detachably secured to the life raft 10 by correspondingly attaching the hook and loop fasteners together. Thus, accessory pouch 22 is releasably attached to the life raft 10 and is readily accessible to a user at all times.

With continued reference to FIG. 2, inflatable life raft 10 further includes a one way inflator valve 54 having a mouth piece and a pivoting stem. Inflator valve 54 is in fluid communication with the inflatable chamber, or air tubes of the life raft 10 for quickly and easily inflating the life raft 10. Inflator valve 54, also illustrated in FIGS. 7 and 9, allows a user to pivotally align the stem towards the user's mouth to insert the mouth piece between the lips of a user so as to quickly inflate the life raft 10 within minutes. Inflator valve 54 is a one way valve permitting air to flow in one direction thus preventing air from escaping out from valve 54.

Figure 3:
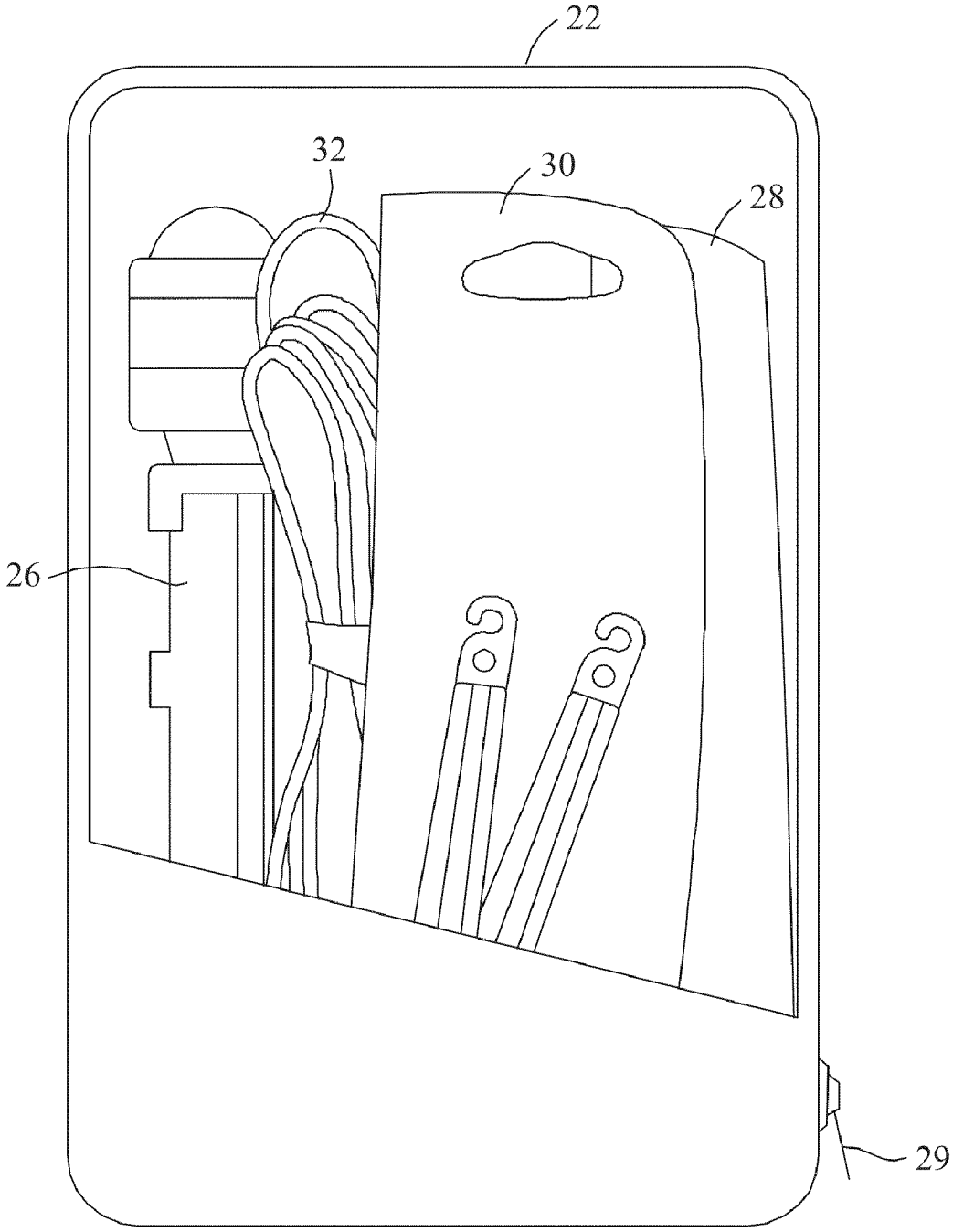
FIG. 3. is a plan front view of the detachable accessory pouch including a variety of different accessories stored therein, according to the present invention.

With reference to FIG. 3, there is shown a plan front view of the detachable accessory pouch 22 including a variety of different accessories stored therein, according to the present invention. The accessory pouch 22 of the present invention may include an opaque or transparent window for allowing a user to view the contents of the pouch 22. Accessory pouch 22 includes a fastener, preferably a zipper 29, for securely storing the accessories therein. The accessory pouch 22 is fabricated from a waterproof material to maintain the accessories dry, and may include any shape or size and dimensioned to form one or more receptacles for holding a variety of accessories therein.

Figure 4:
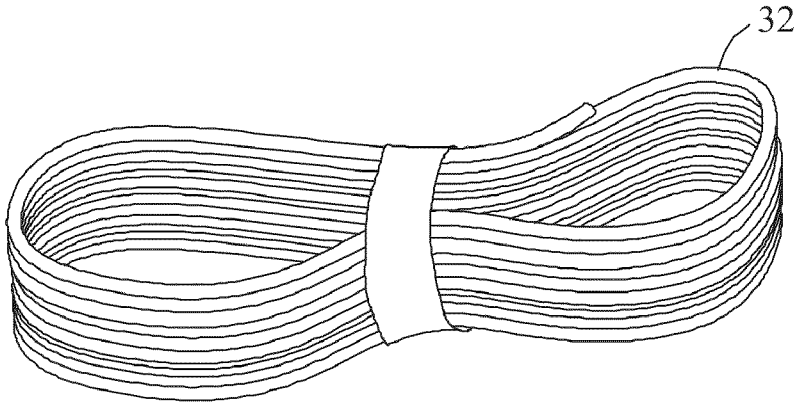
FIGS. 4, 5, and 6, are perspective views of a variety of different accessories of FIG. 3, according to another embodiment of the present invention.
Figure 4:
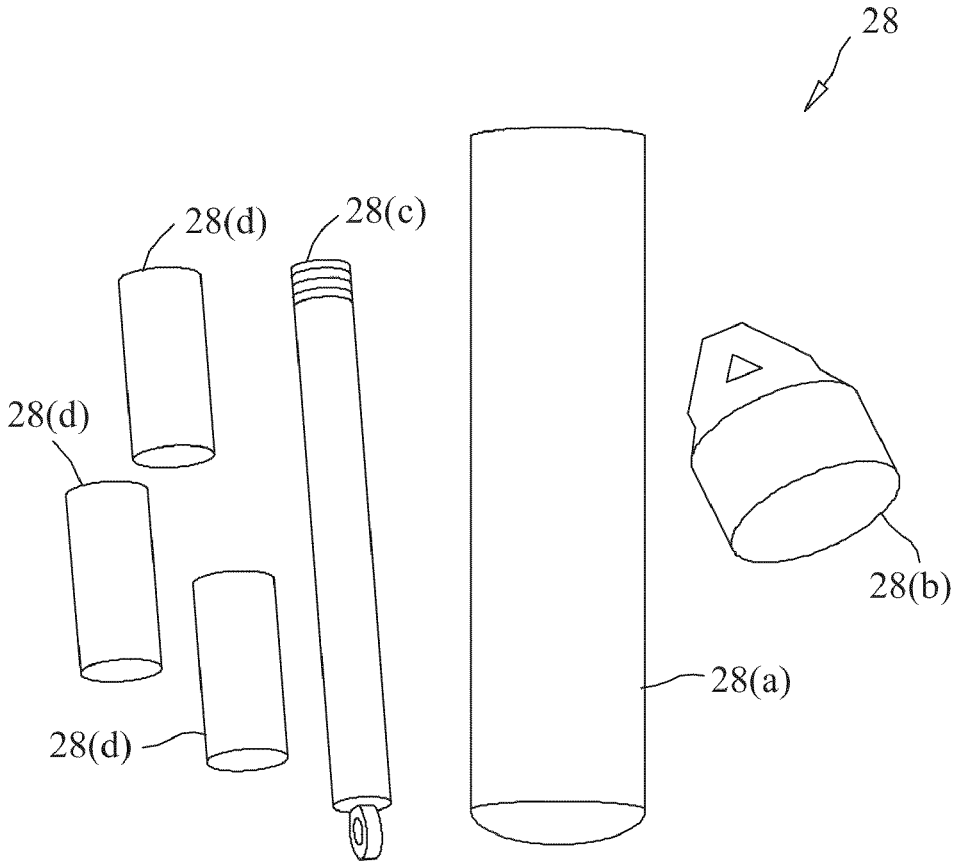
Figure 5:
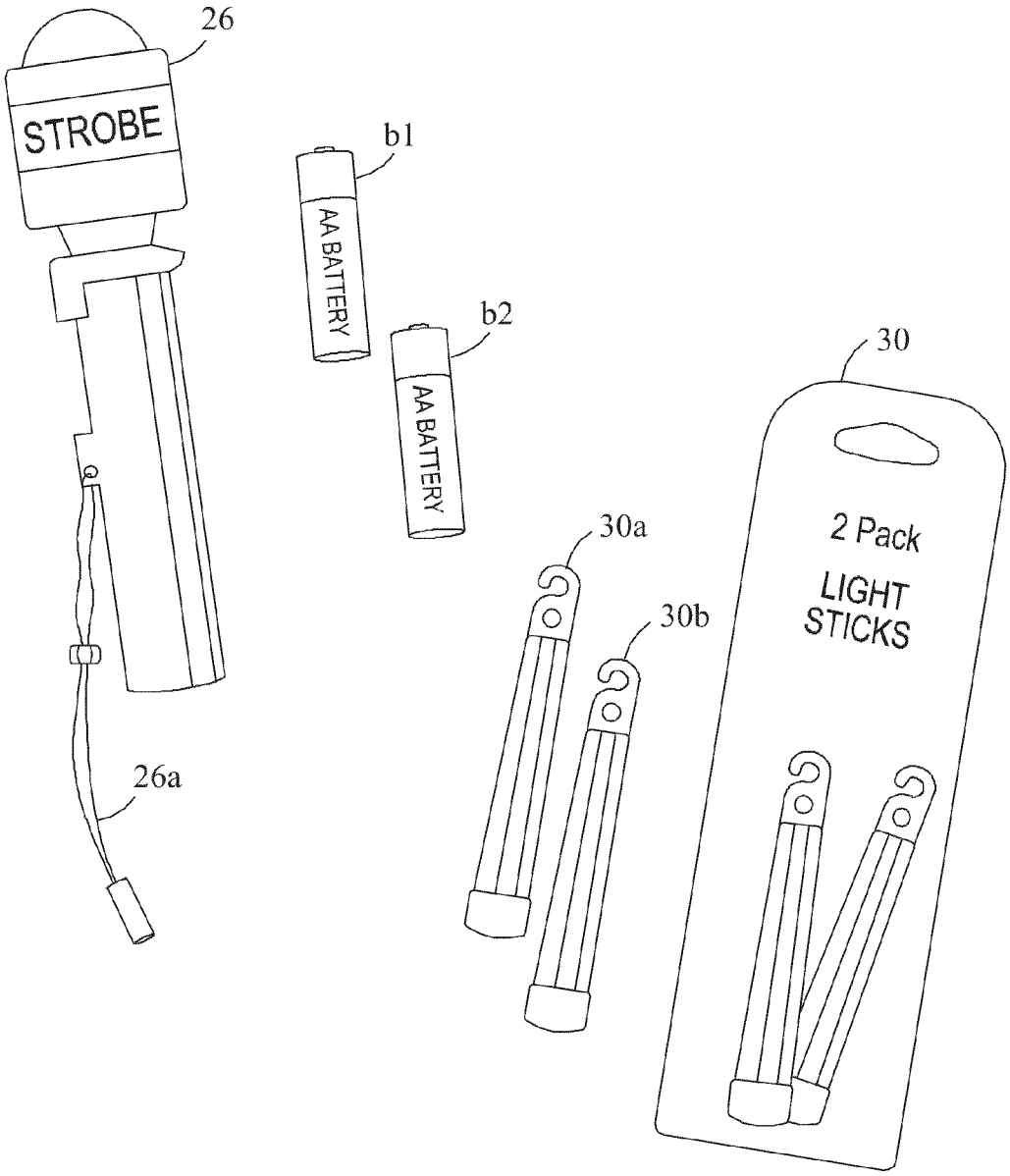
Figure 6:
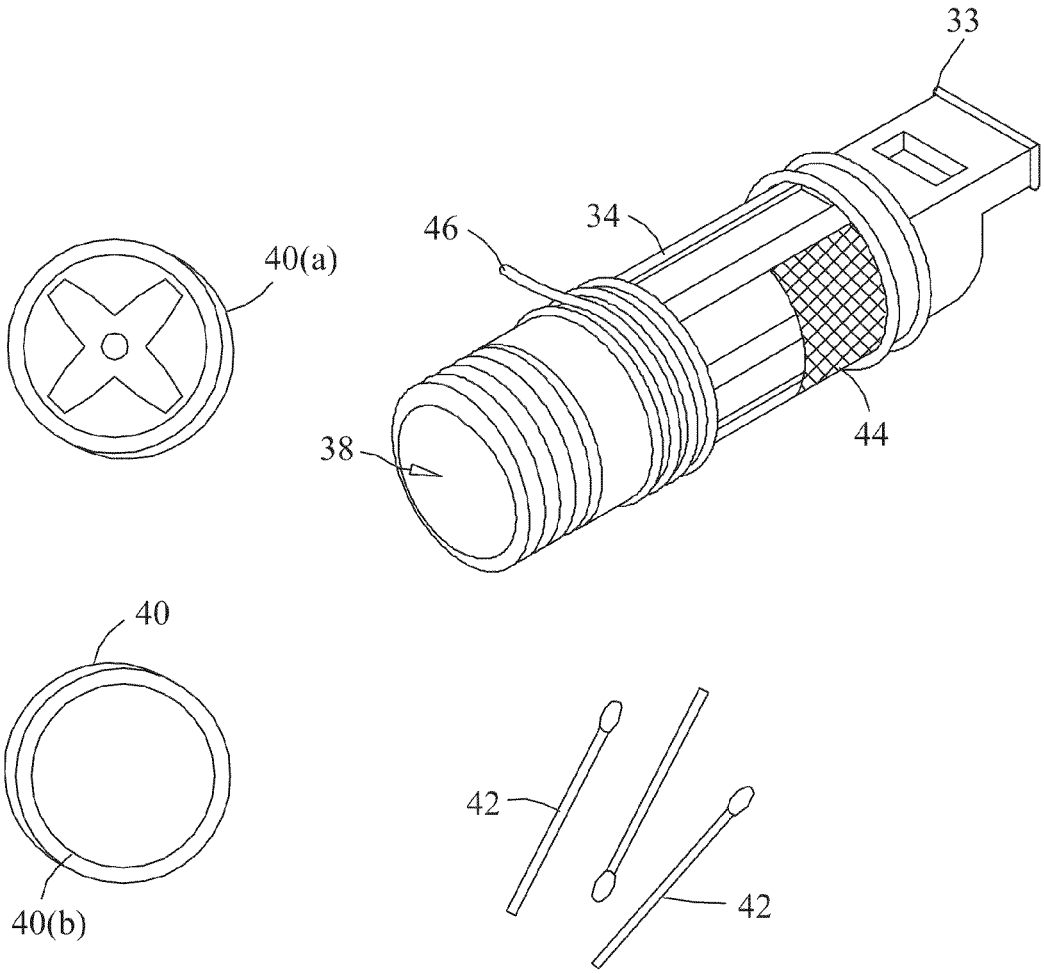

Turning now to FIGS. 4, 5 and 6, there are shown perspective views of a variety of different accessories that are readily stored within accessory pouch 22, according to the present invention. Such accessories may include tools, food, water, beverages, safety equipment, clothing, maps, lotion, patches, or any small and portable item or article a user may wish to pack during the recreational or personal safety use of life raft 10. Some non-limiting examples of a variety of accessories selected for storage within the accessory pouch 22 include a rope 32, and a flare system 28. Rope 32 may comprise any diameter, material and length, such as a 6-foot nylon rope 32. The flare system 28 includes a waterproof flare container 28*a*, and container closure 28*b*. The flare container 28*a* is sized to store a flare launcher 28*c*, and a plurality of launch flares 28*d*. Flare launcher 28*c* is used to launch flares 28*d* vertically into the air to signal boats, rafts, airplanes or other people in the event of an emergency.

With reference now to FIG. 5, other examples of accessories include a strobe light 26 including a hand strap 26*a*, and one or more batteries b1 and b2 needed to power strobe light 26. Strobe light 26 may include bright light emitting bulbs or diodes that emit one or more colors, that flash, or that remain on or cycle on and off. Strobe light 26 has a convenient hand strap 26*a* for securely holding the strobe light 26 in hand. Preferably strobe light 26 is fabricated from a waterproof, durable material that permits the strobe light 26 to remain afloat on top of water in the event the strobe light 26 slips loose from a user's hand. Alternatively, strobe light 26 may also include a neck strap for positioning the strobe light 26 around a user's neck, if desired.

Still other examples of accessories further include a chemiluscent glow stick package 20. A chemiluscent glow package 20 may include a plurality of chemiluscent sticks 30*a*, and 30*b* that are readily available to provide light to a user. Chemiluscent glow sticks 30*a*, 30*b* provide a resourceful light source without having to store or rely on an additional flashlight and batteries, thereby taking up less space, and limiting expenses. Extended use of a flashlight tends to drain the batteries overtime. When activated by a user, each chemiluscent glow stick 30*a*, 30*b* can provide an efficient light source that lasts for hours.

FIG. 6 illustrates yet another example of an accessory including a whistle 34. Whistle 34 includes a mouth piece 33, a receptacle 38, a closure 40, and a whistle rope 46. As most standard whistles, mouth piece 33 is designed to be inserted between the user's lips for blowing and generating a whistling sound. Closure 40 is threadably removed from the end of whistle 34 to expose the opening of receptacle 38. Receptacle 38 is sized to receive and store any small items therein dry. Some examples of small items may include needle and thread, safety pins, medication such as pills or tablets, patches to patch the raft 10, a small lighter or even wet/dry matches 42.

Closure 40 is threadably attached to the end of whistle 34 to secure the small items 42 within receptacle 38. Closure 40 includes a compass 40*a* disposed on the top portion of closure 40, and a reflecting mirror 40*b* disposed within the whistle 34 receiving cavity of the closure 40. Reflecting mirror 40*b* is used to reflect sunlight in the event a user wishes to generate a distress signal. When whistle 34 is fully assembled together, a user can simply attach the whistle 34 around the wrist, neck or belt with rope 46.

Whistle 34 may be fabricated from stainless steel, durable hard plastic, brass or any suitable, rust proof material. Whistle 34 may include a hook and loop fastener 44 for securely attaching the whistle directly to the inflatable life raft 10, or alternatively, whistle 34 may be stored within accessory pouch 22, if preferred.

Figure 7:
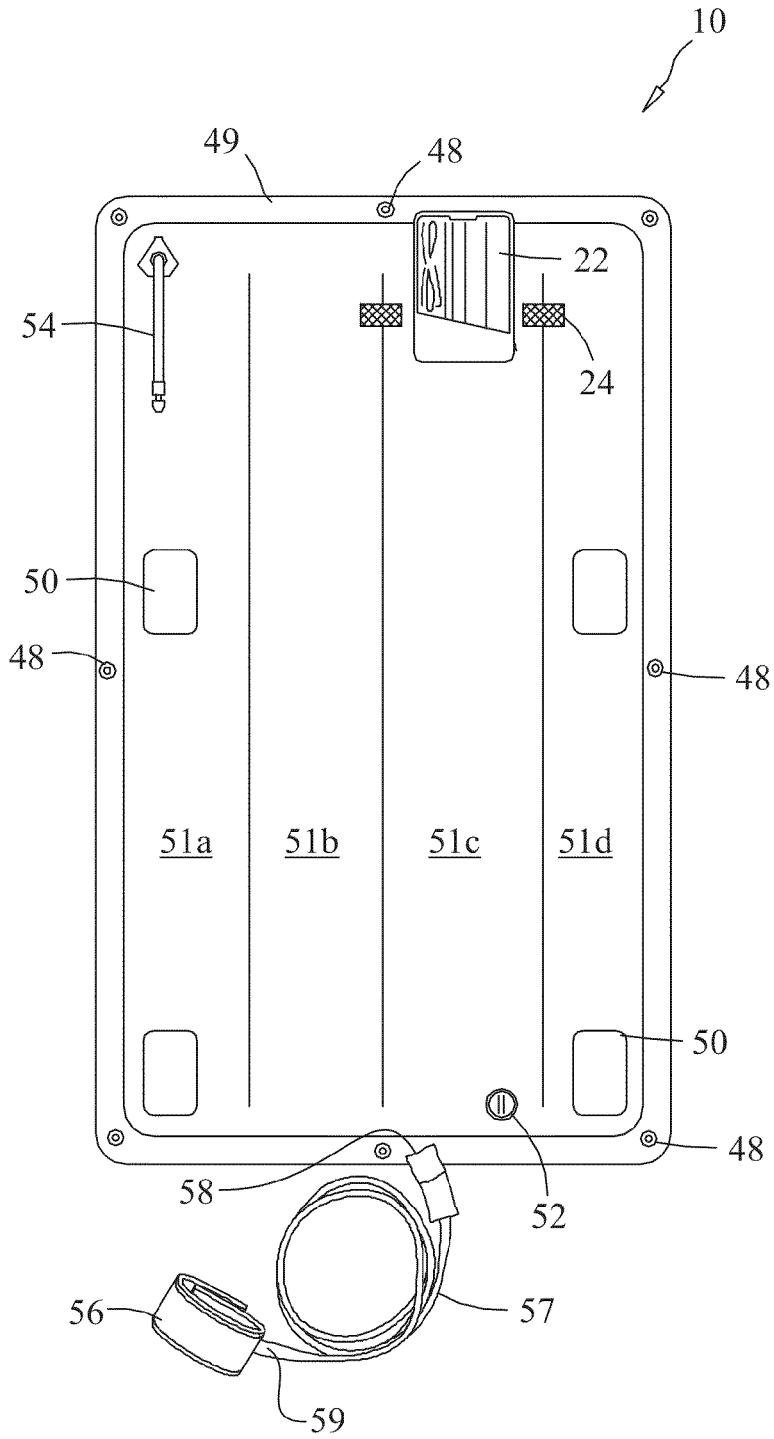
FIG. 7. is a top view of an unfolded, deflated, inflatable device including a tether, and a plurality of reflectors, according to one embodiment of the present invention.

Turning now to FIG. 7, there is shown a top view of the inflatable device 10 including a tether 57, and a plurality of reflectors 50 where the inflatable device 10 is shown in an unfolded, deflated state, according to the present invention. As shown, the inflatable life raft 10 is completely unfolded defining a generally square or rectangular shape. A plurality of longitudinal inflatable air chambers 51*a-d* are aligned in parallel series with each other to form the inflatable chamber of life raft 10. The term "air channels", "air chambers" and "air tubes" are utilised interchangeably, unless specified to have a distinguishing feature therebetween.

A plurality of grommets 48 are mounted along the outer edge flap 49 of the inflatable raft 10 to allow tying life raft 10 securely in place along a deck or boat. Alternatively, a rope may be intertwined within each grommet 48 along the outer perimeter of the life raft 10 to provide a means for holding onto the life raft 10, if preferred. Preferably, each grommet 48 is fabricated from a material that is resistant to corrosion and rust such as brass, stainless steel or plastic.

In addition to the one way inflator valve 54, and accessory pouch 22 detachably attached to the surface of the life raft 10, inflatable life raft 10 further includes a plurality of reflectors 50 mounted on the top or upper surface of life raft 10. Each reflector 50 is securely positioned along the outer edge of the life raft so that a user does not cover the reflecting abilities of each reflector 50 when lying on the surface of the raft 10. Each reflector 50 may be disposed anywhere on the upper surface of the raft 10. For example, reflectors 50 may be disposed about the four corners of the life raft 10, at two corners of the life raft 10 and in the middle, opposite each other, or about the head or feet region of the life raft 10. Each reflector 50 is sized and shaped to optimally reflect light or radar signals from the raft 10. The reflectors 50 may comprise reflective tape, reflective plastic, a mirror-like mylar material or a textile fabric material coated with a metallic material such as silver, or metal foil.

Additionally, each reflector 50 may comprise a radar reflector or reflective material that is detectable by radar. Radar reflectors 50 may be disposed about the top surface of the life raft 10 to allow the raft 10 and user to be detected by radar from a boat or plane. Such reflectors 50 may include a laminated protective cover that is disposed over the reflective material to prevent the reflective material of each reflector 50 from being damaged or contaminated by water.

With continued reference to FIG. 7, inflatable life raft 10 also includes a deflator valve 52, and an ankle tether or strap 57. Deflator valve 52 may comprise any valve means well known in the life raft industry. As described below, deflator valve 52 may be adapted to comprise an inflator valve coupled to a replaceable air cylinder 100 for automatically inflating life raft 10, as better illustrated in FIG. 11. Ankle tether 57 may include a cord, rope or a flexible, elastic cord such as a bungee cord. A first tether end 58 of ankle tether 57 is attached to life raft 10, and a second tether end 59 is attached to a tether attachment feature such as an ankle strap 56. Ankle strap 56 provides a cushioned material including a hook and loop fastener for removeably attaching the ankle strap 56 on a user's ankle thereby coupling the inflatable life raft 10 to the user. The ankle strap 56 and tether 57 not only allow the user to take advantage of the free use of the user's hands and feet, but provides the security of holding onto the inflatable raft 10 in the event of a storm or strong oncoming waves.

Figure 8:
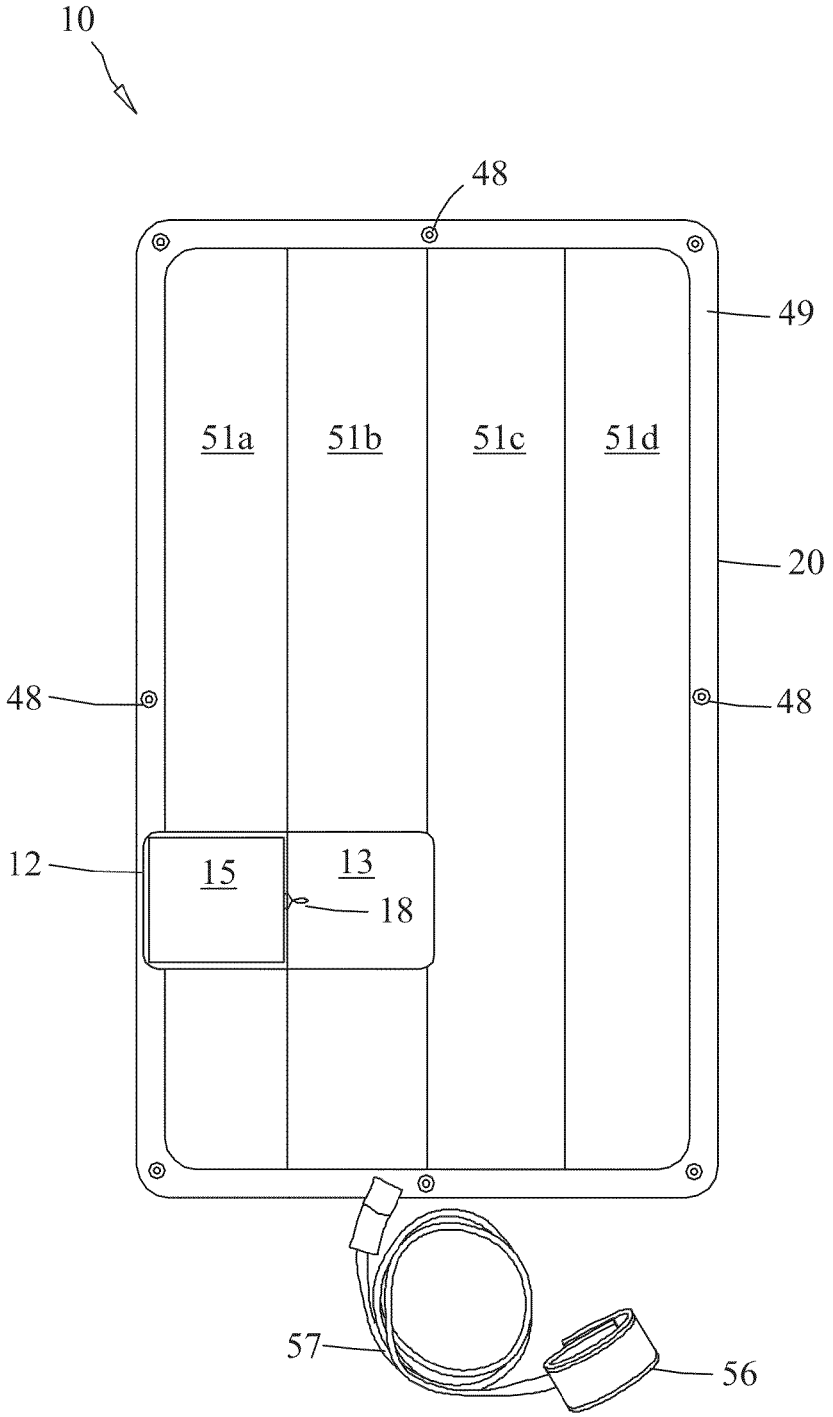
FIG. 8. is a bottom view of the unfolded, deflated, inflatable device including an integrally constructed storage means, a tether, and a parallel series of air chambers, air channels, or air tubes, according to the present invention.

FIG. 8 shows a bottom view of an unfolded, deflated lift raft 10 including an integrally constructed storage means 12, according to the present invention.

Panels 13 and 15, of storage means 12, each form an integral part of the bottom surface of inflatable life raft 10. Inflatable life raft 10 is folded longitudinally and transversely into a small, generally square shape and positioned within the opening or receiving portion of storage means 12. Once the life raft 10 is folded and disposed within storage means 12, panels 13 and 15 are folded together along hinge 11, as shown in FIGS. 1 and 2, like a book and zipper 14, 16 is fastened to provide a compact, stored, inflatable life raft 10, as illustrated in FIG. 1. Hanging clip 18 can be used to attach the stored inflatable life raft 10 to a person, belt or to be hung in a closet or the like.

Figure 9:
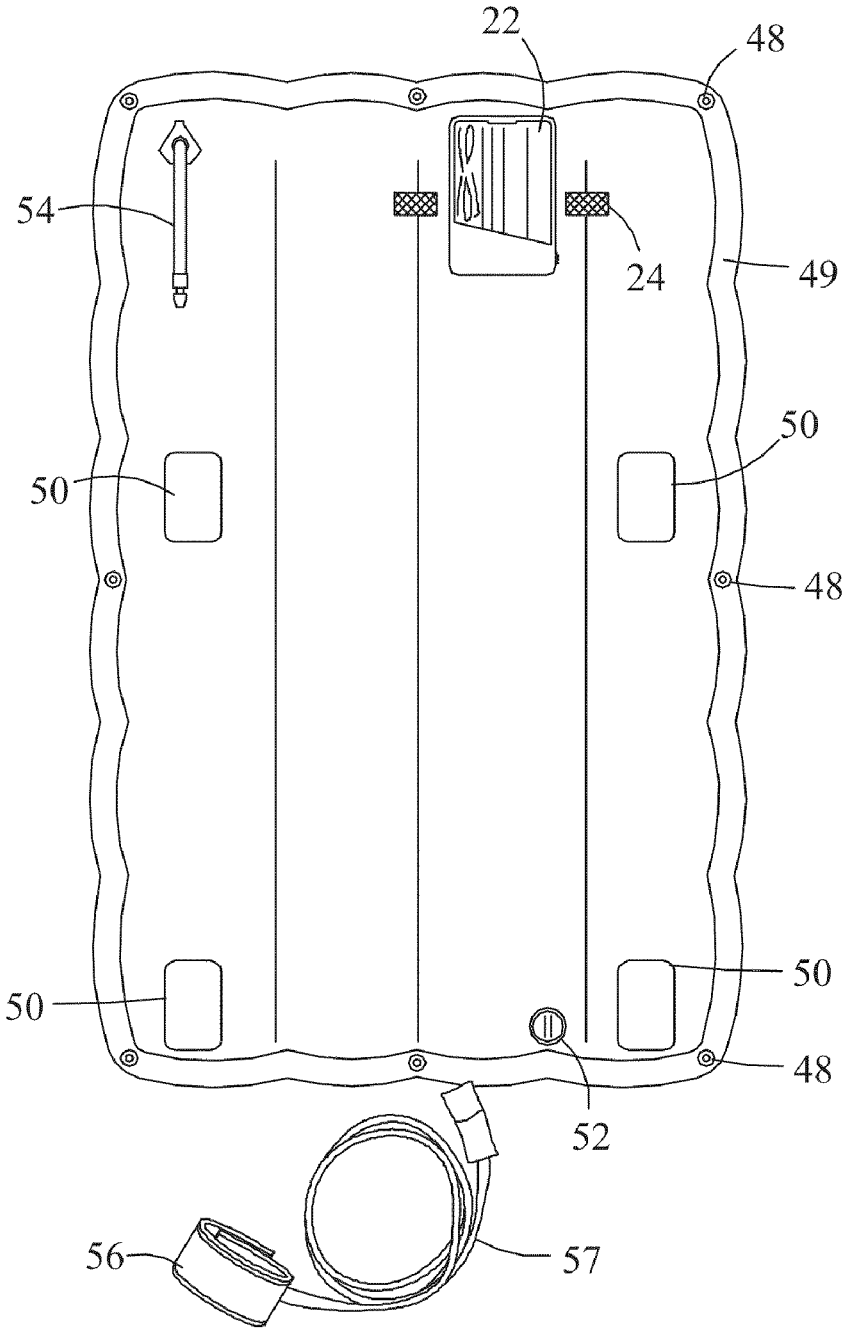
FIG. 9. is a top view of the inflatable device of FIG. 7, shown inflated.

Upon use, fastener 14, 16 is unzipped along panels 13, 15, and panels 13, 15 are unfolded about hinge 11, to unfold inflatable life raft 10 as shown in FIGS. 2, 7 and 8. A user places the mouth piece of inflator valve 54 between the user's lips and generates air to fully inflate life raft 10, as depicted in FIG. 9.

Figure 10A:
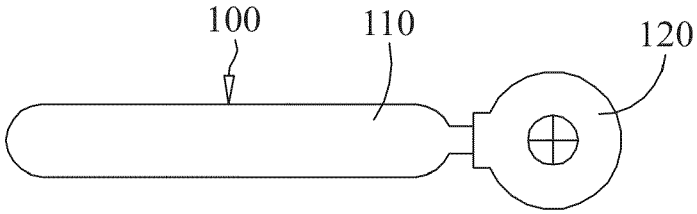
FIGS. 10A and 10B are plan views of a replaceable gas cylinder and loader, according to an alternative embodiment of the present invention.
Figure 10B:
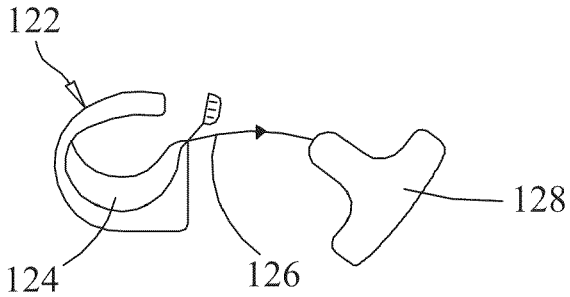

Turning now to FIGS. 10A and 10B there are shown plan views of a replaceable gas cylinder 100 and cylinder loader 122 used in combination for automatically inflating the inflatable device 10. In one embodiment, the replaceable cylinder 100 includes a replaceable air cylinder that includes a light alloy cylinder 110 filled with compressed air, and a valve connecting member 120 that is in fluid communication with cylinder 110. Alloy cylinder 110 is sized to hold the requisite amount of air that is needed to inflate life raft 10. The valve connecting member 120 is adapted to engage with valve 52 for forceably directing air from cylinder 110 into the life raft 10, as better illustrated in FIG. 11. The replaceable air cylinder 100 is coupled to an air cylinder loader 122, as depicted in FIG. 10B. Air cylinder loader 122 includes a cylinder receptacle 124, a loader pull string 126 and a pull string handle 128 attached to pull string 126 for activating air cylinder 110 to inflate life raft 10.

Air cylinder loader 122 is fixedly disposed on life raft 10 about valve 52. Replaceable air cylinder 100 is loaded within the air cylinder loader 122 such that the valve connecting member 120 of air cylinder 100 is operatively coupled to valve 52. With the replaceable air cylinder 100 and loader 122, the personal safety life raft 10 can be stored in its original pouch shape with little added weight.

In operative use, a user unzips life raft 10, along zipper 14, and grasps the pull string handle 128 in one hand. The user pulls handle 128 to automatically inflate life raft 10. Upon activation, air is directed from cylinder 110, through valve member 120, into the life raft 10, via valve 52. Upon activating the replaceable air cylinder 100, life raft 10 is immediately inflated and ready for use with very little effort needed by the user. Thus, the replaceable air cylinder 100 provides a user an alternative vehicle for automatically inflating the life raft 10 in the event a user is unable to use the manual inflator valve 54. After use, air cylinder 100 may be replaced with a new cylinder for subsequent inflation of raft 10.

In one alternative embodiment, the replaceable gas cylinder 100 is a replaceable or refillable gas cylinder such as a CO2 gas cylinder or canister. The CO2 gas cylinder is operatively coupled to valve 52, via, cylinder loader 122. Preferably, the CO2 cylinder is preattached to valve 52. However, if desired, the CO2 cylinder may be stored in the accessory pouch and selectively coupled to valve 52 for readily inflating the raft. In operative use, a user unzips life raft 10, along zipper 14, grasps pull string handle 128 in one hand, and pulls the handle 128. The force operates to activate the CO2 gas cylinder to automatically inflate life raft 10. Once activated, CO2 gas flows from the CO2 gas cylinder and is directed into raft 10, via valve 52. Thus, by pulling handle 128, CO2 gas is immediately initiated into the life raft 10 fully inflating the life raft 10 within a relatively short period of time with little effort required by the user. Thus, the replaceable gas cylinder 100 provides an easy, and quick alternative method for quickly inflating life raft 10. The expired or exhausted CO2 gas cylinder may be easily replaced with a new CO2 gas cylinder, or refilled accordingly.

Figure 10C:
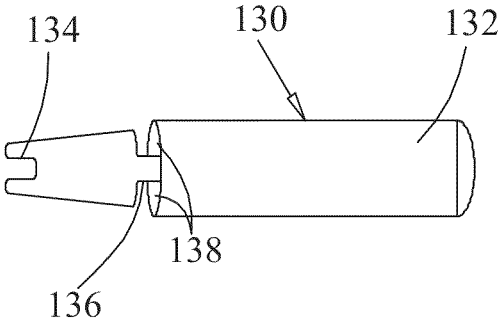
FIG. 10C is a plan view of a manual air pump used for inflating the inflatable device of FIG. 1.
Figure 11:
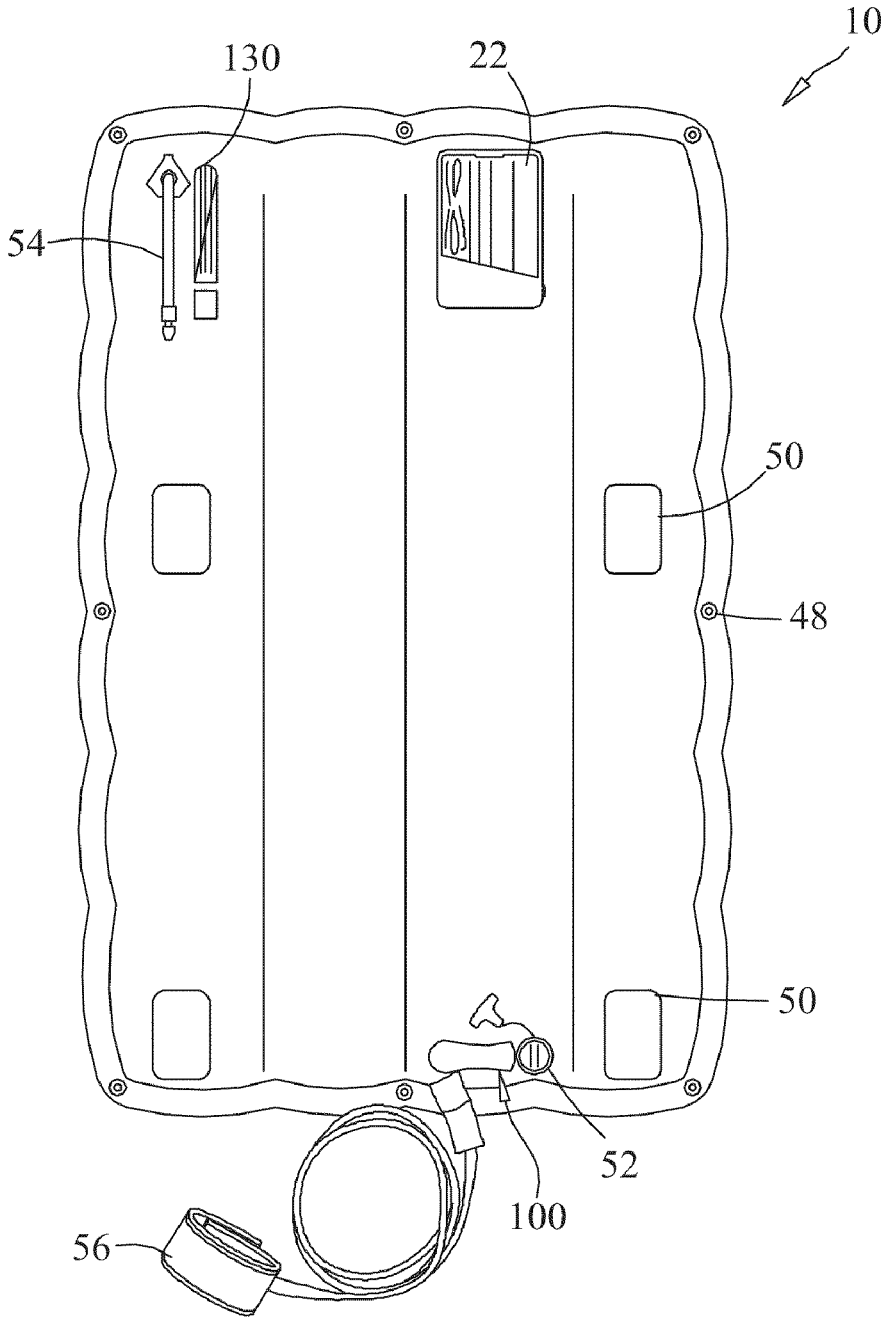
FIG. 11 is a top view of the inflatable device of FIG. 7, including a replaceable gas cylinder and manual hand pump, in an alternative embodiment of the present invention.

FIG. 10C shows a plan view of a manual air pump 130 used for inflating life raft 10. Manual hand pump 130 includes a cylinder 132, a pump connector 134, a shaft 136 and a one-way breather seal 138. Manual hand pump 130 is stored on the raft 10 near inflating valve 54. Pump connector 134 is adapted to couple to filler hose or inflating valve 54, as illustrated in FIG. 11. In use, pump connector 134 is coupled to inflating valve 54 and the user uses two hands to stroke shaft 136 back and forth within cylinder 132 to inflate life raft 10. A user of life raft 10 has three operative modes of inflating life raft 10. A first mode includes breathing into fill tube 54, a second mode includes manually inflating life raft 10 using a hand pump 130, or alternatively a third mode which includes automatically inflating life raft 10 with a replaceable gas cylinder 100.

Figure 12:
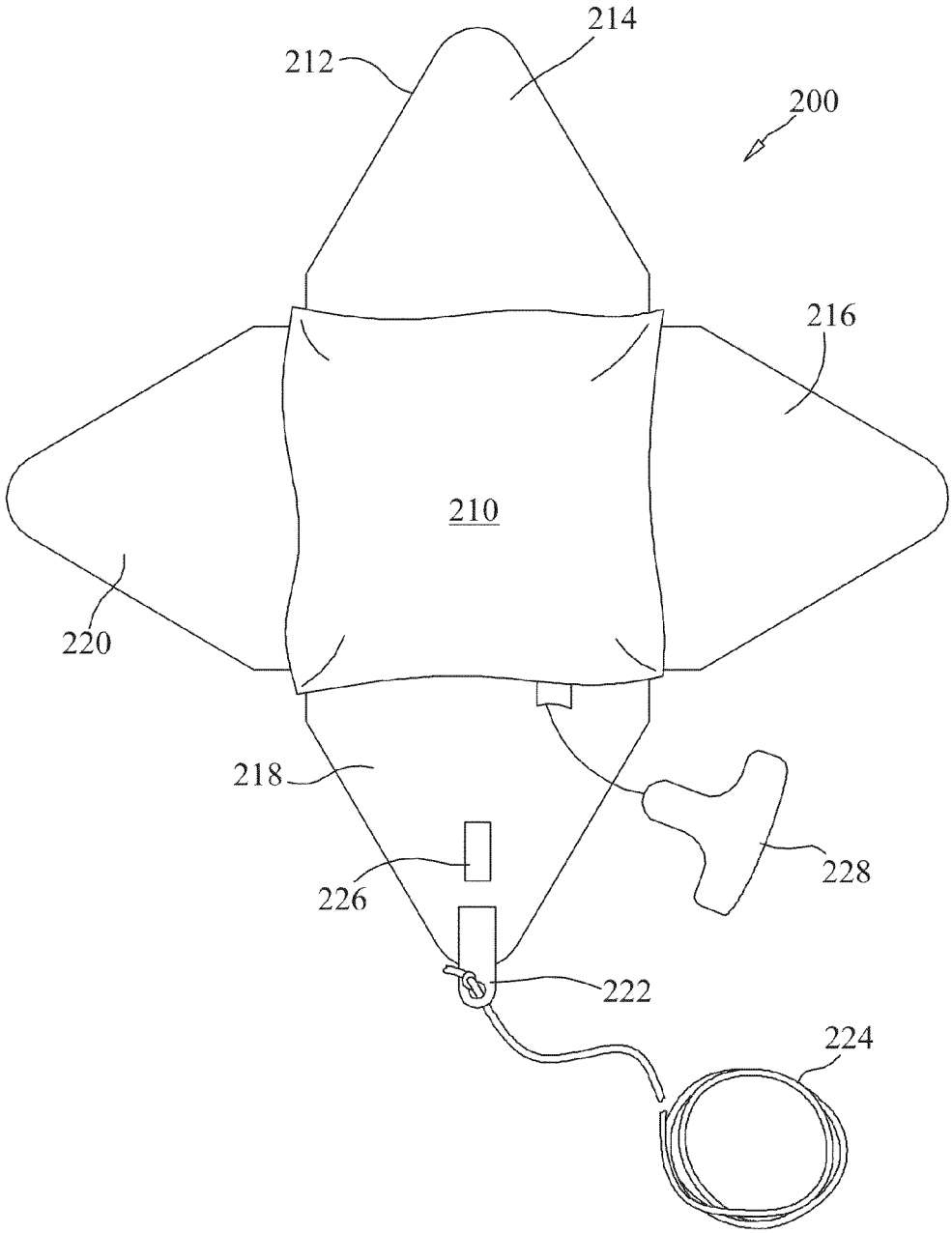
FIGS. 12, 13 and 14 are top views of the inflatable device of FIG. 11, shown deflated and folded in an easy, deployable storage means that is integrally constructed with the device, according to another embodiment of the present invention.
Figure 13:
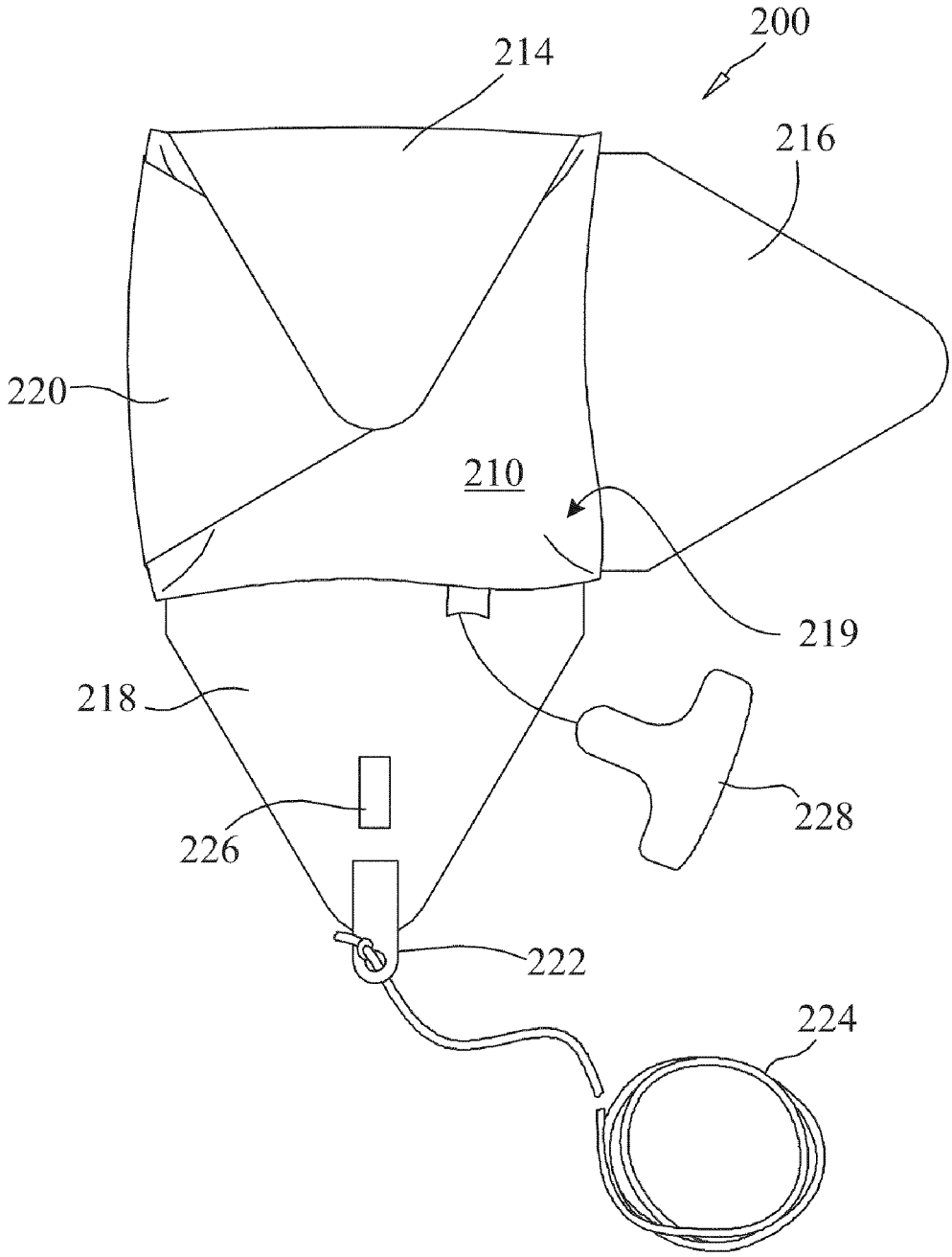
Figure 14:
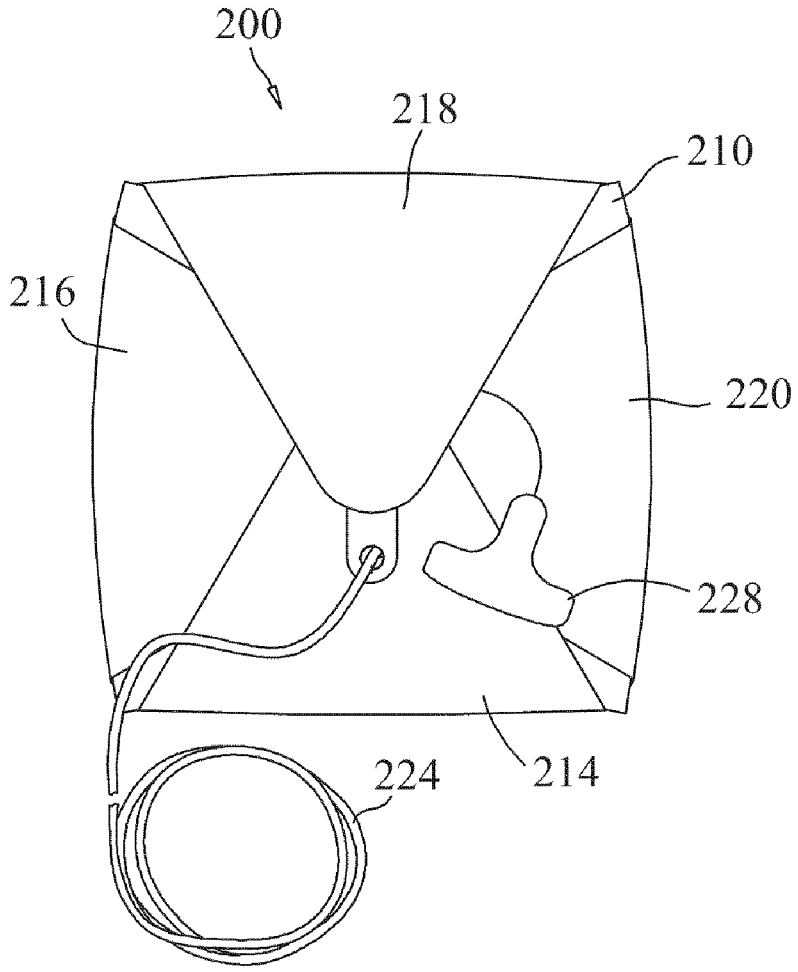

Turning now to FIGS. 12 through 14, there are shown top views of a readily deployable inflatable device 200 showing an inflatable life raft 210 deflated and folded in a storage assembly 212, according to another embodiment of the present invention. The storage assembly 212 includes envelope panels 214, 216, 218 and 220. Each panel 214, 216, 218, 220 includes a generally triangular shape resembling a closure flap of an envelope. The panels 214, 216, 218, 220 foldably combine together to form a storage container 219 for securely storing the life raft 210. Panels 214, 216, 218, 220 can be integrally constructed formed from a single blank, or comprise separately individual panels that are attached to one side of the raft 210 for readily providing storage as is also outlined in another embodiment with reference being made to panels 13, 15 of FIG. 8. Each panel 214, 216, 218, 220 is dimensioned and sized to cover a corresponding section of raft 210, and is fabricated from any durable material including but not limited to plastic, fabric, rubber, or vinyl.

The storage assembly 212 includes a panel 218 having an extending flap 222 with an opening for receiving one end of a rope 224. Panel 218 also includes an assembly fastener 226 for securely holding the panels 214, 216, 218, 220 in a folded position over the folded raft 210. One non-limiting example of an assembly fastener 226 is a hook and loop fastener. Other fasteners could be implemented including snaps and magnets.

For properly storing the inflatable raft 210, life raft 210 is folded longitudinally and transversely into a small, generally square shape and positioned within a central region of the storage assembly 212 where each panel 214, 216, 218, 220 extends outwards from all four edges of the folded raft 210 into a planar configuration, as better illustrated in FIG. 12. As shown in FIG. 13, each panel 214, 216, 218, 220 is folded one by one over the raft 210 into a folded configuration as illustrated in FIG. 14. All four panels 214, 216, 218, 220 are fastenly folded via, assembly fastener 226 to create the storage container 219 for storing the raft 210 in a readily deployable manner. A hanging clip can be used to attach the stored inflatable life raft 10 to a person, belt or hung in a closet or the like, if desired.

As shown in FIG. 14, both the rope 224 and gas cylinder pull handle 228 are readily exposed. To quickly and easily deploy the raft 210, the user holds on to the rope 224 and simply pulls handle 228. Upon pulling handle 228, the gas cylinder 100 is activated to rapidly inflate raft 210 where the storage assembly 212 unfolds effortlessly providing for immediate deployment and inflation a desired feature in saving lives.

The advantages of the present invention offers an inflatable life raft 10 that can be easily stored in compact form, can be easily carried and transported, and can be used for both recreation and personal safety. The inflatable life raft 10 can be fabricated in a variety of different dimensions and made readily accessible to children and adults. The present invention also provides the advantages of an inflatable life raft 10 having a detachable waterproof pouch for holding a variety of safety items or accessories made available to a user at all times, and a tether for coupling the life raft 10 to a user if desired. Advantageously, the present invention provides three modes for operatively inflating life raft 10 one of which includes an automatic mode of inflation.

The inflatable device of the present invention may be constructed to include an inflatable boat, mattress, bed, or any other suitable inflatable device used for recreation or personal safety. As variations, combinations and modifications may be made in the construction and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but defined in accordance with the foregoing claims appended hereto and their equivalents.

What is claimed is:

1. A compact storable life raft comprising:

at least one air chamber said at least one air chamber forming a generally rectangular shaped body when said life raft is unfolded and inflated;

valves in fluid communication with said at least one air chamber for inflating and deflating said at least one air chamber;

an accessory pouch releasably attached to one surface of said body, wherein said accessory pouch enables storage of a plurality of accessories therein;

a tether defined by a first tether end and a second tether end, wherein said tether is connected to said body at said first tether end, said tether comprising a tether attachment feature carried by a second tether end for being removeably connected to a user; and a storage assembly constructed integrally with another surface of said generally rectangular shaped body, said storage assembly defined having a plurality of foldable panels extending outward from said another surface of rectangular shaped body;

said plurality of foldable panels are folded over said life raft when said life raft is folded and deflated creatin a storage container for storing said life raft;

a fastener carried by at least one foldable panel for securely holding said plurality of foldable panels in a folded position over said life raft, when said life raft is folded and deflated;

said plurality of foldable panels return to a planar configuration upon unfastening said fastener, providing effortless deployment of said life raft, and including a clip for securing said life raft to a person, object or for hanging.

2. The compact storable life raft of claim 1, wherein said life raft is fabricated from a flexible material composed of any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

3. compact storable life raft of claim 2, wherein said valves comprise a first valve having a filling stem for inflating said air chamber, and a second valve for releasing or inserting air from or within said air chamber.

4. The compact storable life raft of claim 3, wherein said tether includes a tether strap, one end of said tether strap attached to said body, and a second end of said tether strap attached to an ankle attachment for removeably attaching said tether on a user's ankle.

5. The compact storable life raft of claim 4, wherein said accessory pouch includes a fastener for securely storing said plurality of accessories, said plurality of accessories comprising a rope, a flare launching system, a strobe light, glow sticks, and a whistle, said whistle including a receptacle for receiving items, and a closure having a reflecting mirror and a compass.

6. The compact storable life raft of claim 5, further including a plurality of reflectors disposed on said one surface of said body.

7. The compact storable life raft of claim 6, wherein said folded normally deflated life raft includes a plurality of grommets disposed along an outside perimeter flap of said life raft.

8. The compact storable life raft of claim 3, wherein said life raft further includes a replaceable gas cylinder, and a manual air pump, said replaceable gas cylinder stored within a cylinder loader and coupled to said second valve for inflating said life raft, said manual air pump releasably coupled to said first valve for manually inflating said life raft.

9. An inflatable device comprising:

a life raft comprising a first sheet joined and sealed to a second sheet to form a generally, rectangular shaped body having one or more inflatable air chambers, and an outside perimeter flap;

a storage assembly, said storage assembly defined having a plurality of foldable panels, including at least one foldable panel comprising an assembly fastener, wherein said plurality of foldable panels are folded creating a storage container for receiving said life raft in a deflated and folded form when said storage panel is plurality of foldable panels are placed into a folded configuration and fastened and returns to a planar configuration upon unfastening said assembly fastener, providing effortless deployment of said life raft, wherein said storage assembly is attached to one of said first and second sheets;

valves in fluid communication with said one or more inflatable air chambers;

a storage bag for storing items therein, said storage bag removeably attached to said first sheet with a pouch fastener; and a holding strap attached to said inflatable device, said holding strap including a fastener for coupling said device to a user's ankle, waste or wrist.

10. The inflatable device of claim 9, wherein said sheets comprise any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

11. The inflatable device of claim 10, wherein said valves include a one way inflating valve for directing air in said air chamber, and a deflator valve for releasing air from said one or more inflatable air chambers.

12. The inflatable device of claim 11, wherein said items include a rope, a flare launching system, a strobe light, glow sticks, and a whistle, said whistle including a receptacle for receiving small items, and a closure having a reflecting mirror and a compass.

13. The inflatable device of claim 12, further including a plurality or reflectors or reflective material disposed on an exposed surface of said first sheet.

14. The inflatable device of claim 12, further including a plurality of grommets secured at preselected positions along the outside perimeter flap of said device.

15. The inflatable device of claim 12, wherein said fastener includes any one of a spring clip, zipper, hook and loop, buckle, snaps, strap, cord, quick release, magnets, hooks, clasps, carabiner, or any combination thereof.

16. An inflatable recreational or personal safety raft comprising;

a life raft comprising a first sheet joined and sealed to a second sheet to form a rectangular shaped body having a plurality of longitudinally extending inflatable air chambers, and an outer perimeter flap;

a storage assembly, said storage assembly defined having a plurality of foldable panels, including at least one foldable panel comprising an assembly fastener, wherein said plurality of foldable panels are folded creating a storage container for receiving said life raft in deflated and folded form when said plurality of foldable panels are placed into a folded configuration and fastened and said plurality of foldable panels return to a planar configuration upon unfastening providing effortless deployment of said life raft, valve in fluid communication with said inflatable air chamber;

a waterproof pouch provided for storing contents therein, said waterproof pouch removeably attached to said first sheet with a fastener;

a tether attached to said inflatable raft, said tether including a fastener for coupling said inflatable raft to a user's ankle, waste or wrist; and wherein said sheets are suited to construct inflatable recreational or personal safety rafts.

17. The inflatable recreational or personal safety raft of claim 16, wherein said sheets comprise a single ply or multiple ply of any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

18. The inflatable recreational or personal safety raft of claim 17, wherein said valve includes a one way valve for directing air in said air chamber, and a deflator valve for releasing air from said air chamber.

19. The inflatable recreational or personal safety raft of claim 18, further including stored contents, wherein said stored contents includes a rope, a flare launching system, a strobe light, glow sticks, and a whistle, said whistle including a receptacle for receiving small items, and a closure having a reflecting mirror and a compass.

20. The inflatable recreational or personal safety raft of claim 19, further including any one of a plurality or reflectors disposed on an outer surface of said first sheet, a plurality of grommets secured along the outer perimeter flap, a replaceable gas cylinder stored within a cylinder loader and coupled to said valve for inflating said life raft, and a manual air pump releasably coupled to said valve for manually inflating said life raft.

* * * * *